US009156298B2

(12) United States Patent
Nichols et al.

(10) Patent No.: US 9,156,298 B2
(45) Date of Patent: Oct. 13, 2015

(54) METHOD OF PRODUCING A GRAPHIC DESIGN ON A VEHICLE BODY

(71) Applicant: Ford Global Technologies, LLC, Dearborn, MI (US)

(72) Inventors: Mark Edward Nichols, Washtenaw, MI (US); Tony Misovski, Oxford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 101 days.

(21) Appl. No.: 13/832,541

(22) Filed: Mar. 15, 2013

(65) Prior Publication Data

US 2014/0272337 A1 Sep. 18, 2014

(51) Int. Cl.

| | |
|---|---|
| ***B41M 5/00*** | (2006.01) |
| ***B41M 3/00*** | (2006.01) |
| ***B05D 1/38*** | (2006.01) |
| ***B05D 3/02*** | (2006.01) |
| ***B05D 3/06*** | (2006.01) |
| ***B41M 7/00*** | (2006.01) |

(52) U.S. Cl.

CPC ..... *B41M 5/0047* (2013.01); *B05D 1/38* (2013.01); *B05D 3/0254* (2013.01); *B05D 3/065* (2013.01); *B41M 3/00* (2013.01); *B41M 5/0058* (2013.01); *B41M 5/0064* (2013.01); *B41M 7/009* (2013.01); *B41M 7/0045* (2013.01); *B41M 7/0054* (2013.01); *B41M 7/0081* (2013.01); *B41M 2205/38* (2013.01); *B41M 2205/40* (2013.01); *Y10T 428/24868* (2015.01)

(58) Field of Classification Search

None

See application file for complete search history.

(56) References Cited

U.S. PATENT DOCUMENTS

| | | | |
|---|---|---|---|
| 4,954,559 | A | 9/1990 | Den Hartog et al. |
| 5,006,413 | A | 4/1991 | Den Hartog et al. |
| 5,017,673 | A | 5/1991 | Balatan |
| 5,051,464 | A | 9/1991 | Johnson et al. |
| 5,066,732 | A | 11/1991 | Savino et al. |
| 5,100,735 | A | 3/1992 | Chang |
| 5,157,069 | A | 10/1992 | Campbell |
| 5,169,719 | A | 12/1992 | Balatan |
| 5,204,404 | A | 4/1993 | Werner, Jr. et al. |
| 6,579,397 | B1 | 6/2003 | Spain et al. |
| 6,951,376 | B2 | 10/2005 | Ishikawa |
| 6,984,280 | B2 | 1/2006 | Spain et al. |
| 7,271,213 | B2 | 9/2007 | Hoshida et al. |
| 7,611,069 | B2 | 11/2009 | Clifford et al. |
| 7,854,985 | B2 | 12/2010 | Song et al. |
| 8,361,603 | B2 | 1/2013 | Yokoi |
| 2003/0179269 | A1 | 9/2003 | Yamanouchi et al. |
| 2005/0212181 | A1 | 9/2005 | Evans et al. |
| 2010/0183820 | A1 | 7/2010 | Seubert et al. |
| 2011/0094664 | A1 | 4/2011 | Song et al. |
| 2011/0253950 | A1 | 10/2011 | Nash et al. |

FOREIGN PATENT DOCUMENTS

| | | | |
|---|---|---|---|
| WO | 9403337 | A2 | 2/1994 |

*Primary Examiner* — William Phillip Fletcher, III

(74) *Attorney, Agent, or Firm* — Damian Porcari; Alleman Hall McCoy Russell & Tuttle LLP

(57) ABSTRACT

A method is provided for printing graphic designs in-line during manufacture of a vehicle. The method utilizes an ink jet printing system to apply graphic designs over an uncured base coat of paint on the vehicle surface followed by the application of a protective clear coat over the graphic design.

13 Claims, 2 Drawing Sheets

METHOD OF PRODUCING A GRAPHIC DESIGN ON A VEHICLE BODY

BACKGROUND OF THE INVENTION

Embodiments described herein relate to a method of providing a graphic design on a vehicle body and to the graphic design produced thereby. More particularly, embodiments described herein relate to a method which includes printing a graphic design by ink jet printing between a base coat and a clear top coat on a vehicle body such that the graphic design exhibits improved durability.

Currently, graphic designs such as pin stripes, decals, and the like are laboriously applied by hand to the exterior of automotive vehicles after the vehicle has been fully assembled and painted. Such graphics are typically provided in the form of adhesive-backed decals which are applied manually to vehicle surfaces. The decals are then subjected to a thermal curing step such as by using infrared lamps to ensure that they adhere properly to the outer surface of the clear coat paint. However, one drawback of applying the decals to the outer surface of vehicles is that they are not durable over long periods of time as they are exposed to various environmental conditions. Other drawbacks are that manual application of the decals is labor intensive, adding to costs. In addition, the application of decals to the vehicle surface results in surface discontinuities which are undesirable from a visual perspective.

It would be desirable to be able to provide graphic designs beneath the outer clear coat so as to provide protection of the graphics, thus improving durability and visual aesthetics.

SUMMARY OF THE INVENTION

Embodiments of the invention provide such graphic designs in-line during manufacture of the vehicle. The method utilizes an ink jet printing system to apply graphic designs over an uncured base coat of paint on the vehicle surface followed by the application of a protective clear coat over the graphic design. The process can be automated, providing cost savings, and utilizes the clear coat on the vehicle to protect the graphic designs, providing a more durable and aesthetically desirable product. By "graphic design," we mean any letter, symbol, number, image, visual or pictorial representation of an object, including any combination of letters, symbols, numbers, images, and visual or pictorial representations.

According to one aspect of the invention, a method for producing a graphic design on a vehicle body is provided which includes providing a vehicle body having a surface thereon and applying a base coat of paint to the vehicle surface; where the base coat comprises one or more pigments and solvents, and has a surface energy of from about 35 to 50 $J/m^2$. A portion of the solvent(s) from the base coat is then flashed off or vaporized to stabilize the paint surface. A graphic design is then printed on the uncured base coat utilizing ink jet ink, where the ink jet ink has a surface energy which is less than or equal to the surface energy of the base coat such that the inkjet ink wets the surface of the underlying base coat. A clear top coat of paint is then applied over the vehicle surface containing the printed graphic design and base coat. The vehicle body is then subjected to a conventional curing operation for the painted surfaces such as, for example, exposure to UV radiation, thermal radiation, or a combination thereof.

In one embodiment, the method may include curing the ink comprising the graphic design prior to application of the clear coat. In this embodiment, the ink may be cured by exposure to UV radiation such as, for example, a UV light source, although other methods of curing the ink may be utilized within the scope of the invention.

The method of providing the graphic design may be performed in-line during manufacture of the vehicle. In one embodiment, the graphic design is applied robotically using ink jet ink.

The ink jet ink preferably comprises a pigment and a binder, and may comprise water-based or solvent-based inks.

The clear coat preferably contains one or more stabilizing additives such as a UV light absorbing additive or a hindered amine light stabilizer. Such additives aid in protecting the printed graphic design as well as the underlying base coat from long term exposure to sunlight, protecting the color(s) in the design and providing durability.

Upon curing, the base coat has a thickness of about 0.4 to 1 mil (about 10 to 25 μm), the graphic design has a thickness of about 0.01 to 0.10 mil (about 0.25 to 2.5 μm), and the clear coat has a thickness of about 1 to 3 mils (about 25 to 75 μm). By providing the graphic design between the base coat and top coat, the resulting vehicle body, including graphic design, is free of surface discontinuities.

The application of the graphic design by printing with ink jet ink also provides advantages in that the ink is applied in line in a vehicle paint spraying operation, not as a post-assembly operation. The ink is jetted onto the uncured base coat such that the base coat, graphic design, and clear coat can all be cured at the same time in a single operation.

Accordingly, it is a feature of embodiments of the invention to provide a method of producing a graphic design on a vehicle body which utilizes an ink jet ink positioned between the paint base coat and clear coat of a vehicle body. Other features and advantages of the invention will be apparent from the following description, the accompanying drawings, and the appended claims.

DETAILED DESCRIPTION

Figure 1:
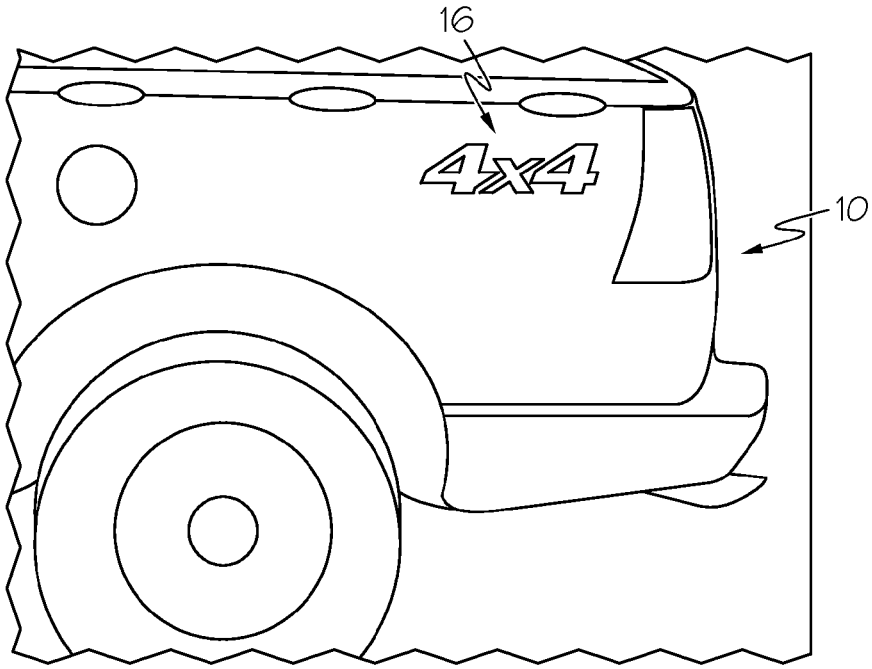
FIG. 1 is a side view of a portion of a vehicle body having a graphic design made by an embodiment of the present invention.

Embodiments of the method described herein enable the application of graphic designs to a vehicle body surface between a base paint coat and protective clear top coat. The method provides a number of advantages over prior methods of providing graphic designs on vehicle bodies in that it eliminates the surface discontinuities caused by surface-applied graphic design decals. The method also provides improved durability of the graphic design by locating the graphic design beneath the clear coat. The method also allows the graphic design to be provided in-line in an automotive paint spray booth or the like in an automated manner without human labor, i.e., via printers which operate robotically.

Unless otherwise indicated, the disclosure of any ranges in the specification and claims are to be understood as including the range itself and also anything subsumed therein, as well as endpoints.

A preferred base coat paint for use in the method is comprised of one or more pigments, solvents such as water, and a polymeric binder. The base coat preferably has a surface energy of from about 35 to 50 $J/m^2$. Suitable base coat paints for use in the method include urethane, polyester, and acrylic-based paints commercially available from, for example, BASF, DuPont, and PPG. The patent literature is replete with descriptions of automotive paints. See, e.g., U.S. Pat. No. 5,169,719 (Balatan, BASF) which teaches water-dilutable polyurethane/acrylic copolymers useful as the principal resin and as pigment grind resins in waterborne automotive basecoats. U.S. Pat. No. 5,157,069 (Campbell, BASF) teaches an aqueous coating comprising a nonionic dispersion of a polymer selected from the group consisting of acrylic resin, polyurethane resin (and mixtures thereof) with a nonionic water soluble rheology control polymer (such as a polyether, cellulose, cellulose derivative, polyvinyl alcohol, etc.) and pigments. U.S. Pat. No. 5,066,732 (Savino et al., BASF) teaches water dispersible nonionic polyurethane resins having polyether backbones. U.S. Pat. No. 5,017,673 (Balatan, BASF) teaches water dispersible nonionic polyurethane resins having polyester backbones. U.S. Pat. No. 5,204,404 (Werner Jr., et al., DuPont) teaches water based coating compositions containing an acrylic silane polymer and a polyurethane polymer. U.S. Pat. No. 5,051,464 (Johnson et al., DuPont) teaches a water based coating composition containing an acrylo-urethane pigment dispersing polymer and a binder. U.S. Pat. Nos. 5,006,413 and 4,954,559 (Den Hartog et al., DuPont) teach water based coating compositions containing a methylol (meth)acrylamide acrylic polymer binder and a polyurethane. U.S. Pat. No. 5,100,735 (Chang, DuPont) teaches an improved process for forming a multilayer finish on an automobile comprising using a waterborne acrylic basecoat and a high solids, solvent-based acrylic, polyester, or polyester urethane clear coat with an alkylated melamine formaldehyde crosslinking agent.

The ink jet ink used to print the graphic design may be thermally curable or UV curable and may comprise water-based or solvent-based inks. The ink may be acrylic or polyester-based and preferably comprises at least a pigment and a binder. Suitable ink jet inks include the Triangle® series of inks such as MUFX UV curable ink and HPS (solvent-based, UV light resistant, pigmented) ink from INX Digital International Inc. Other suitable ink jet inks include solvent-based and water-based inks from DuPont, Sun Chemicals, Fujifilm, and Kodak. It is important that the ink jet ink be capable of wetting the underlying uncured base coat. In order to provide sufficient wetting, the ink jet ink must have a surface energy which is less than or equal to that of the paint base coat. In general, paint base coats have a surface energy ranging from about 35 to 50 $J/m^2$, and typically about 40 $J/m^2$. The ink should have a surface energy which is lower than or approximately equal to the base coat but sufficient to allow the subsequently applied clear coat to wet the ink.

The clear top paint coat used in the method preferably comprises an acrylic or urethane-based paint and includes one or more stabilizing additives such as a UV light absorbing additive or a hindered amine light stabilizer. The automotive clear coat paints for use in the method are formulated to be compatible with the underlying base coats. Suitable clear coat paints are commercially available from the same manufacturers as listed above.

The method of applying the coatings to the vehicle body surface may take place in-line during manufacture of the vehicle, i.e., in a moving assembly line. For example, as the vehicle moves through the paint area, the appropriate amount of base coat is applied to the vehicle body. After application of the base coat, the solvent in the base coat is allowed to evaporate, or flash, for a short time (about 1 minute). This enhances the stability of the base coat before the graphic design is printed onto the base coat surface and eliminates jet ink bleed at the edges of the printed graphic design.

In a preferred embodiment, after application and flashing of the base coat, the vehicle then moves past a robot or other automated device with an ink-jet head mounted thereon. The robotic equipment, which is operated under computer control, prints the appropriate graphic design over the surface of the base coat. Suitable robotic equipment for use in the method is commercially available from, for example, Fanuc, Durr, and ABB. It should be appreciated that any type of robotic equipment may be used in the method as long as it has the ability to position a print head close to the vehicle body and move it in a pre-determined fashion relative to the vehicle body. Software to control movement of the ink jet printing heads on the robotic arms is also commercially available.

Alternatively, a simpler method of application may utilize an automated "arm" that is programmed to apply ink in a design as the vehicle is moved past the arm. The arm may have the ability to move in and out as desired to apply the ink to the contours of the vehicle as needed.

The graphic design may be jetted from more than one print head so that multiple colors may be jetted simultaneously or sequentially. After application of the graphic design, the vehicle is then transported for application of the clear coat to the vehicle body. The vehicle containing all three paint layers on its surface is then transported to an oven for curing the coatings.

In an alternative embodiment, the ink jet printed graphic design may be cured prior to the application of the clear coat. This ensures that the design is stable prior to application of the clear coat and avoids strike-in of the ink to the base coat or of the clear coat to the ink. By "strike-in," it is meant the partial dissolution of one layer of paint by a subsequent layer of wet paint applied on top of the first layer. Thus, curing the ink jet ink prior to application of the clear coat helps to prevent the ink from dissolving into the overlying clear coat and/or underlying base coat. Curing of the ink jet printed graphic design can be accomplished either robotically or by the use of fixed UV light sources. For example, a UV-LED light source may be used.

In another alternative embodiment of the method, the vehicle body may be painted while remaining stationary. In this embodiment, the vehicle is painted by an array of robots which move around the vehicle to apply the respective basecoat, ink jet printed graphic design, and clear coat. The painted vehicle body may then be transported to a curing station as described above.

It should be appreciated that regardless of the method used to apply the three coatings, sufficient time should elapse between the application of the base coat, ink jet graphic design, and clear coat. Typically, each coat should be allowed to dry for about 30 seconds to 3 minutes before application of the overlying coat, and more preferably, for about 1 to 2 minutes. For example, if the clear coat is applied too soon after the base coat is applied, bleeding of the coatings and/or a muddy interface will occur, also referred to as "strike-in" or mottling.

Figure 2:
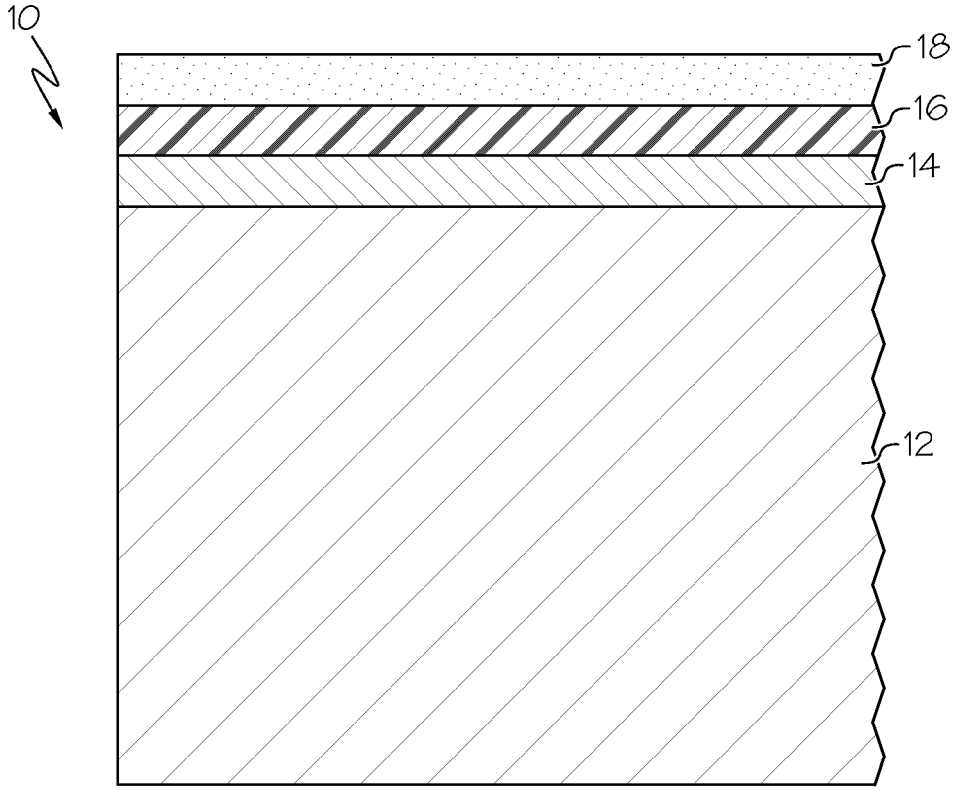
FIG. 2 is a cross-sectional view of the vehicle body taken along line 2-2 of FIG. 1, including a base coat, graphic design, and clear top coat thereon in accordance with an embodiment of the invention.
Figure 3:
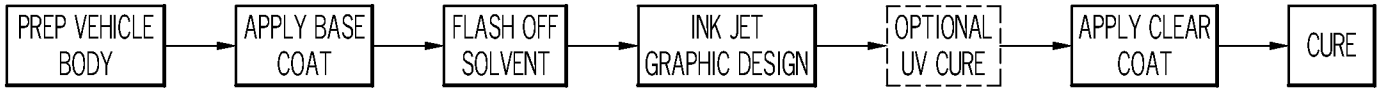
FIG. 3 is a flow chart illustrating the steps in the process of producing a graphic design on a vehicle body in accordance with an embodiment of the invention.

Referring now to FIGS. 1 and 2, a portion of a vehicle body with a graphic design as well as a cross-sectional view of the vehicle body is shown. The painted vehicle body 10 includes a body surface 12, a base coat 14 applied over the body surface, a graphic design 16 printed over the base coat 14, and a clear top paint coat 18 applied over the graphic design and base coat. It should be appreciated that in a typical manufacturing process, prior to application of the basecoat, the vehicle is typically provided with a conversion coating, electrocoat, and primer coat (not shown).

In order that the invention may be more readily understood, reference is made to the following examples, which are intended to illustrate the invention, but are not to be taken as limiting the scope thereof.

EXAMPLE 1

A white OEM base coat of paint from BASF was applied to a pre-primed steel panel by a drawdown application bar. The base coat was allowed to flash off solvent for one minute, then a graphic design was ink jet printed on the surface in the shape of a rectangular stripe of about 1 cm×10 cm. The ink was applied using a Xaar Proton ink jet head and utilized a black MUFX UV curable ink from INX Digital International Inc. The ink was jetted onto the panel surface at a stand-off distance of 1 mm. After application of the ink, the ink was UV cured by passing the panel under a Fushion UV H bulb for about 10 seconds. Immediately after UV curing, an automotive clear coat (UreGloss® from BASF) was applied to the panel. The panel was then allowed to flash off solvent for about 5 minutes before it was placed into a 140° C. oven for 30 minutes to cure the basecoat and clear coat. Upon removal of the panel from the oven, the graphic design maintained a well-defined stripe with crisp edges, i.e., no bleeding of the ink occurred at the edges.

EXAMPLE 2

A white OEM base coat of paint from BASF was applied to a pre-primed steel panel by a drawdown application bar. The base coat was allowed to flash off solvent for one minute, followed by printing a graphic design with ink jet ink on the surface in the shape of a rectangular stripe of about 1 cm×10 cm. The ink was applied using a Xaar Proton ink jet head and using a black HPS solvent borne ink from INX Digital International Inc. The ink was jetted onto the panel surface at a stand-off distance of 1 mm. After application of the ink, an automotive clear coat (UreGloss® from BASF) was applied to the panel. The panel was then allowed to flash off solvent for about 5 minutes before it was placed into a 140° C. oven for 30 minutes to cure thebase coat, graphic design, and clear coat layers. Upon removal of the panel from the oven, the graphic design maintained a well-defined stripe with crisp edges.

EXAMPLE 3

The ink coated panels of Examples 1 and 2 were tested for durability. The panels were placed in an accelerated weathering device including a xenon-arc lamp (Atlas Ci65A from Ametek Corporation). The panels were tested according to the SAE J2527 accelerated weathering protocol. Borosilicate inner and outer filters were used around the lamp.

Both panels passed 4000 kJ/m$^2$ of accelerated weathering, which is equivalent to more than 3 years of natural weathering in Florida. After 4000 kJ/m$^2$, no color fading, loss of gloss, or adhesion degradation was observed for any of the base coat, graphic design, or clear coat layers.

Having described the invention in detail and by reference to preferred embodiments thereof, it will be apparent that modifications and variations are possible without departing from the scope of the invention.

What is claimed is:

1. A method for producing a graphic design on a vehicle body comprising:

providing the vehicle body having a surface thereon;

applying a base coat of paint to said vehicle surface; wherein said base coat comprises one or more pigments and solvents and has a surface energy of about 35 to 50 J/m$^2$;

vaporizing a portion of said solvent from said base coat;

printing the graphic design onto said base coat utilizing an ink jet printing system to apply ink jet ink; said ink jet ink having a surface energy less than or equal to the surface energy of said base coat; and applying a clear top coat over said vehicle surface containing said printed graphic design.

2. The method of claim 1 including curing said coated vehicle surface after application of said base coat, graphic design, and clear coat.

3. The method of claim 2 wherein said coated surface is cured by UV light.

4. The method of claim 2 wherein said coated surface is cured by heating.

5. The method of claim 1 including curing the ink jet ink comprising said graphic design prior to application of said clear coat.

6. The method of claim 4 wherein said ink jet ink is cured by UV light.

7. The method of claim 1 performed in-line during manufacture of the vehicle.

8. The method of claim 1 wherein said ink jet ink is applied robotically.

9. The method of claim 1 wherein said ink jet ink comprises a pigment and a binder.

10. The method of claim 1 wherein said clear coat contains one or more stabilizing additives therein.

11. The method of claim 1 wherein said base coat has a thickness of about 10 to 25 μm.

12. The method of claim 1 wherein said graphic design has a thickness of about 0.1 to 2.5 μm.

13. The method of claim 1 wherein said clear coat has a thickness of about 25 to 75 μm.

* * * * *